US006302075B1

(12) United States Patent
Krieg et al.

(10) Patent No.: US 6,302,075 B1
(45) Date of Patent: Oct. 16, 2001

(54) ROLLER FINGER FOLLOWER SHAFT RETENTION APPARATUS

(75) Inventors: John Joseph Krieg, Spencerport; John Joseph Burns, Rochester, both of NY (US); Nick John Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/479,555

(22) Filed: Jan. 7, 2000

(51) Int. Cl.[7] ..... F01L 1/18

(52) U.S. Cl. ..... 123/90.41; 123/90.42; 123/90.5

(58) Field of Search ..... 123/90.39, 90.4, 123/90.41, 90.42, 90.43, 90.44, 90.46, 90.5; 74/519, 559

(56) References Cited

U.S. PATENT DOCUMENTS 2,385,309 * 9/1945 Spencer .
5,010,856 * 4/1991 Ojala ..... 123/90.36
5,186,130 * 2/1993 Melchior ..... 123/90.35
5,239,951 * 8/1993 Rao et al. ..... 123/90.5
5,273,005 * 12/1993 Philo et al. ..... 123/90.5
5,566,652 * 10/1996 Deppe ..... 123/90.35
5,775,280 * 7/1998 Schmidt et al. ..... 123/90.41
5,921,209 * 7/1999 Regueiro ..... 123/90.22
6,003,482 * 12/1999 Kampichler ..... 123/90.41

* cited by examiner

*Primary Examiner*—Weilun Lo
(74) *Attorney, Agent, or Firm*—John A. VanOphern

(57) ABSTRACT

A roller finger follower (RFF) wherein the shaft of the roller bearing is restrained in the follower finger by the overhead cam. Ends of the shaft are positioned in place in the follower finger by notches formed in the side walls of the follower finger. The notches restrain the shaft from axial movement. The cam in position over the RFF keeps the shaft nested in the notches. Further restraining means are disclosed to keep the shaft loosely nested in the notches in the follower finger before the cam is installed in position.

14 Claims, 8 Drawing Sheets

ROLLER FINGER FOLLOWER SHAFT RETENTION APPARATUS

TECHNICAL FIELD

The present invention relates to valve actuating arms used in internal combustion engines, more particularly to roller finger followers used in overhead cam type internal combustion engines, and most particularly, to a roller finger follower wherein the shaft of the roller finger follower bearing is restrained in the finger laterally by notches in the finger and radially by the overhead cam.

BACKGROUND OF THE INVENTION

Roller Finger Followers (RFF) are widely used in overhead cam internal combustion engines for the sequential opening and closing of the cylinder intake and exhaust valves. In a typical application, the RFF and mating parts, which are part of the engine's valve train system, mechanically link the valves to the lobes of the overhead cam. Through this linkage, rotational motion of the lobes of the cam is translated to axial motion of the valves causing the valves to open and close as required to complete the combustion process.

In normal operation, the RFF must withstand the engine's environment and thus is designed to withstand the forces required to open and close the valves rapidly and repeatedly over the life of the engine. The RFF must also withstand the extreme internal temperatures of the engine, and operate with low friction to minimize wear on the moving parts and to optimize engine efficiency. The RFF is comprised of three major parts—a roller bearing, a transverse roller bearing shaft, and a finger which holds the roller bearing and shaft in fixed relation to the overhead cam lobe. The roller bearing can be of a solid, journal type, or of a needle bearing type having typically 12 to 18 needle bearings positioned between the bearing's internal diameter and the outer diameter of the shaft. Both types are known in the art. Unless otherwise indicated, the term "roller bearing" will apply to both types. The shaft, and roller bearing which is rotatably mounted to the shaft, is received in first and second coaxially aligned bores formed in the side walls of the follower finger, perpendicular to the longitudinal axis of the finger. Once the roller bearing and shaft are installed in the finger in this fashion, the ends of the shaft are mechanically deformed, such as by orbital staking or the like as known in the art, to keep the shaft and bearing in place, radially, and to prevent undesirable axial movement of the shaft relative to the finger.

The mating parts to the RFF include a hydraulic lash adjuster (HLA) member, a valve stem, and a lobe of the overhead cam. The HLA member compensates for thermal expansion and contraction in the valve train and for valve seat wear using internal hydraulic pressure from the engine's lubricating system, as known in the art. In its closed position, the sealing head of the valve is biased against the valve seat by a valve compression spring, which exerts a closing axial force on the valve stem to assure reliable sealing between the valve head and the valve seat. In order to open the valve, the movement of the RFF must overcome the spring's closing force, and it must do so repeatedly.

In operation, on the bottom side of the RFF, a first end of the finger is in contact with the axially moveable valve stem while the opposite second end of the finger is in contact with the stationary HLA member. On the top side of the RFF, with the roller bearing and shaft in position between the first and second ends of the finger, the lobe of the overhead cam is in contact with the roller bearing. By hydraulically compensating for any variation in lash, the HLA member always remains in contact with the second end of the finger, to assure a continuous contact between the cam lobe and roller bearing.

As is well known in the art, under engine operation, as the cam rotates, the lobe portion of the cam stays in rotational contact with the roller bearing to exert a rotational force on the roller bearing and a downward force on the RFF. Since the stationary HLA member in contact with the second end of the finger acts as a fulcrum, the downward force exerted on the roller bearing by the rotating cam lobe translates to a downward force exerted by the first end of the finger on the valve stem to open the valve against the closing force of the valve spring.

As the cam lobe rotates, it remains in contact with and rotates the RFF's roller bearing. The roller bearing rotates on the shaft's cylindrical surface. Since the shaft ends are mechanically staked in place in the bores of the follower finger, there is no relative rotational movement between the shaft ends and the finger bores. Thus, all relative rotational movement within the RFF is between the cylindrical surface of the shaft and the roller bearing.

To reduce wear on the shaft, and to extend the life of the RFF, it is known in the art to fabricate the shaft out of steel and to harden the cylindrical surface of the shaft on which the roller bearing rides through, for example, an induction hardening process. As mentioned above, the roller bearing and shaft are kept in place in the finger by mechanically deforming or staking the ends of the shaft after the shaft is properly positioned in the axially aligned bores. Therefore, to accommodate the staking operation, it is incumbent to localize hardening of the shaft to only that portion of the cylindrical surface of the shaft in contact with the roller bearing. That is, in order to accomplish the mechanical deformation or staking operation, the ends of the shaft must be kept relatively soft. Conversely, the hardness of the cylindrical surface of the shaft in contact with the roller bearing should be relatively hard to resist wear.

A problem with known roller shaft design is that the special handling of the shaft to localize the hardening process is expensive and difficult to maintain. To avoid hardening of the ends of the shaft, the ends must be masked off, selectively softened at the ends, or in some way isolated from the hardening process. Variations in the ability to control localization of the hardening process can lead to excessively hard shaft ends or unacceptably soft areas in the bearing contact zone. This, in turn, could cause either inadequately staked shaft ends which would permit undesirable axial movement of the shaft relative to the follower finger, or cause cracks in the shaft ends from the staking operation. These cracks could loosen the shaft and could lead to premature wear of the RFF. Conversely, variations in the ability to control localization of the hardening process can lead to an under hardened cylindrical surface of the shaft in the bearing contact zone resulting in excessive shaft wear from the rotating roller bearing. In addition, since the dimensional tolerances of the bores in the side walls of the follower finger must be closely controlled in order to assure proper fit between the shaft and the bores and proper alignment of the roller bearing with the cam lobe, careful machining of the finger in order to receive the shaft is a tedious and expensive operation. Further, the staking operation requires extreme care to avoid distorting the walls of the finger that could cause the roller bearing to bind. In addition, once the shaft staking operation is completed, the RFF cannot be readily disassembled. Therefore, should the RFF be found inoperable after the staking operation is completed, the RFF cannot be easily repaired. Finally, in the present design, the selection of a suitable shaft material must accommodate opposing needs. The shaft material has to be hard enough to resist wear from the rotating roller bearing, yet soft enough to be staked in place in the finger to prevent axial movement of the shaft. Thus, material selection for the shaft must be compromised to accommodate these opposing needs.

Also, because of the competing requirements for softness at the shaft ends but hardness in its center, a transition zone of some length is produced. The width of this zone constrains the allowable material thickness of the side walls of the finger requiring it to fully cover the transition zone.

SUMMARY OF THE INVENTION

The present invention is directed to an improved RFF wherein the transverse shaft need not be staked in position once the roller bearing is positioned in the follower finger, the shaft need not be specially handled so as to keep the shaft ends soft for staking, and the shaft material can be selected to optimize wear resistance, without the need for the shaft ends to be soft for the staking operation.

First, the follower finger of the present invention has side walls as in the prior art. However, rather than incorporating tight toleranced, machined through bores to receive the roller bearing shaft, the finger of the present invention incorporates a notch in each side wall wherein the ends of the shaft nest in the notches to restrain the roller bearing. These notches can be incorporated into the finger during the forming process. Special machining is not required. Once the overhead cam is in its assembled position above the RFF, the cam lobe in contact with the roller bearing keeps the roller bearing in place radially in the finger. The side wall notches prevent undesirable axial movement of the roller bearing shaft and keep the roller bearing in proper contact with the cam lobe.

Second, since the side wall notches of the finger keep the roller bearing and roller bearing shaft in proper axial position, mechanical deformation of the ends of the shaft to prevent axial movement of the shaft is no longer necessary. This permits the entire length of the shaft to be reliably hardened for improved wear or for the shaft material to be optimized to minimize wear.

Third, since the ends of the shaft of the improved RFF are not necessarily fixed to the finger and could be allowed to axially rotate relative thereto within the notches, localized wear on the shaft by the rotating bearing is eliminated thereby extending the wear life of the RFF.

Fourth, in instances where relative rotational motion is split between the roller bearing and shaft and the shaft and follower finger, shaft wear is further reduced.

Fifth, to aid in the handling of the RFF prior to assembling on the engine, that is, to keep the roller bearing and shaft from falling free from the follower finger before the RFF is installed on the engine, further improvements are incorporated. These improvements include contoured notches in the finger to help retain the shaft and/or novel shaft clips to secure the shaft to the finger from upward movement, in addition to constraining lateral movement of the needle bearings where needle bearings are used, without interfering with the function and performance of the improved RFF and valve train assembly.

Other features and advantages of the invention, as well as presently preferred embodiments thereof, will become better understood and more apparent after reading the following description in conjunction with the accompanying drawings.

DESCRIPTION OF THE PREFERRED EMBODIMENT

Figure 1A:
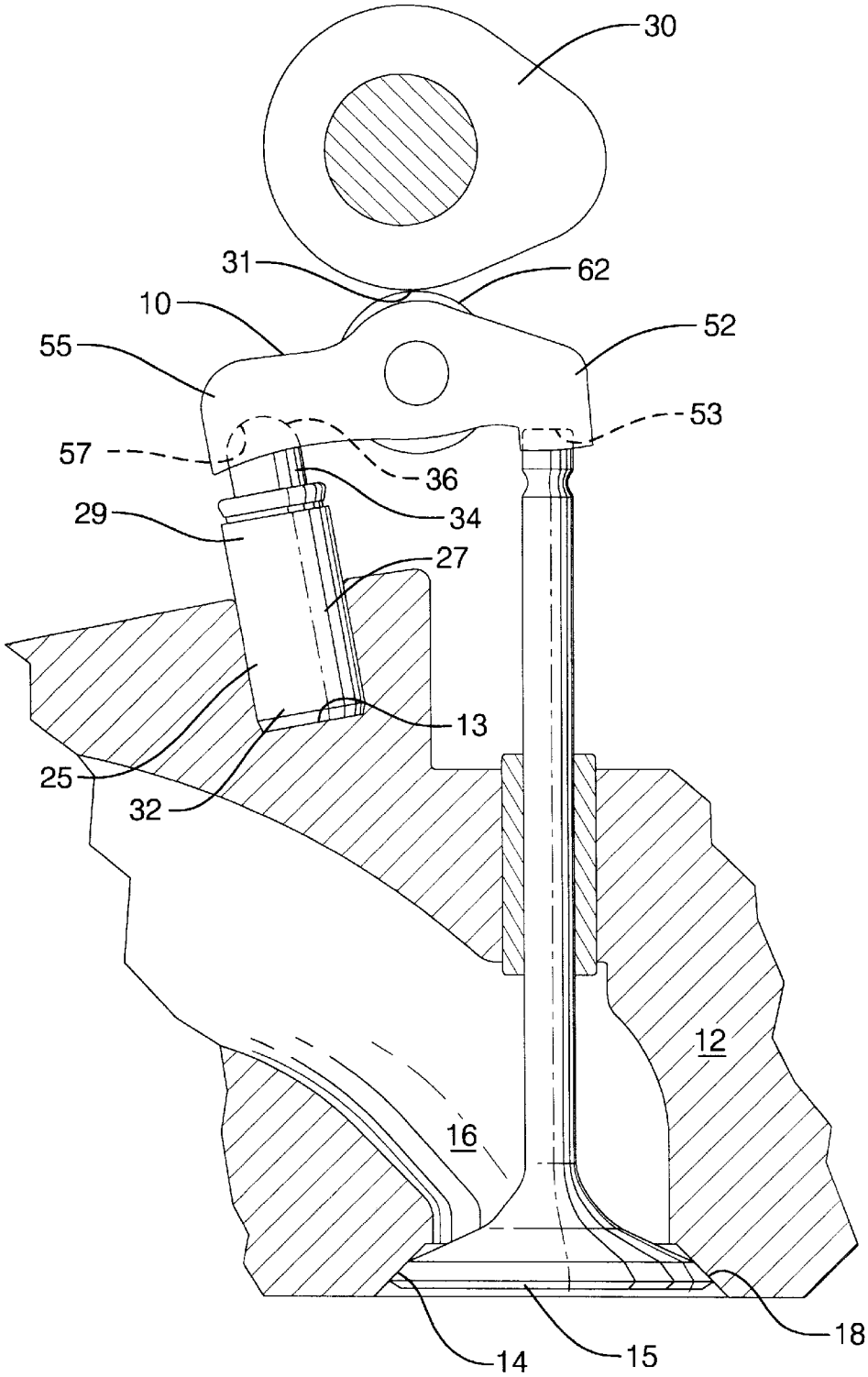
PRIOR ART FIG. 1 A
FIG. 1A is a schematic drawing of a Roller Finger Follower (RFF) and its mating parts in a typical overhead cam engine application.

Referring to FIG. 1*a*, a typical prior art Roller Finger Follower (RFF) 10 with mating parts for an overhead cam engine is shown. The mating parts include valve 15 and valve stem 20, hydraulic lash adjuster (HLA) member 25, and cam lobe 30.

As readily known in the art, valve 15 is mounted in cylinder head 12 for axial movement within valve guide (not shown) in the cylinder head. Valve compression spring (not shown) is fixed at one end to valve stem tip 22 by a split keeper or the like as known in the art, and is seated at its other end on the cylinder head 12. With the compression spring assembled in this fashion, valve seating surface 18 is biased against cylinder head seat 14 to close valve port passage 16.

HLA member 25 of known type having elongated, generally cylindrical body 27 with upper end 29 and lower end 32 is positioned in the cylinder head in proximity to its associated valve stem. Within the body of the HLA member is internal reservoir chamber into which oil is delivered by the engine's lubricating system as understood in the art. At upper end 29 of HLA member 25 is a moveable plunger 34. Plunger 34 includes spherical shaped cap 36. A hydraulic column is provided by the delivered oil to bias the plunger and cap upward. The hydraulic mechanism, which is of conventional, well known construction, will not be described herein in detail. Lower end 32 of HLA member 25 is seated in mating pocket 13 in the cylinder head.

Figure 2:
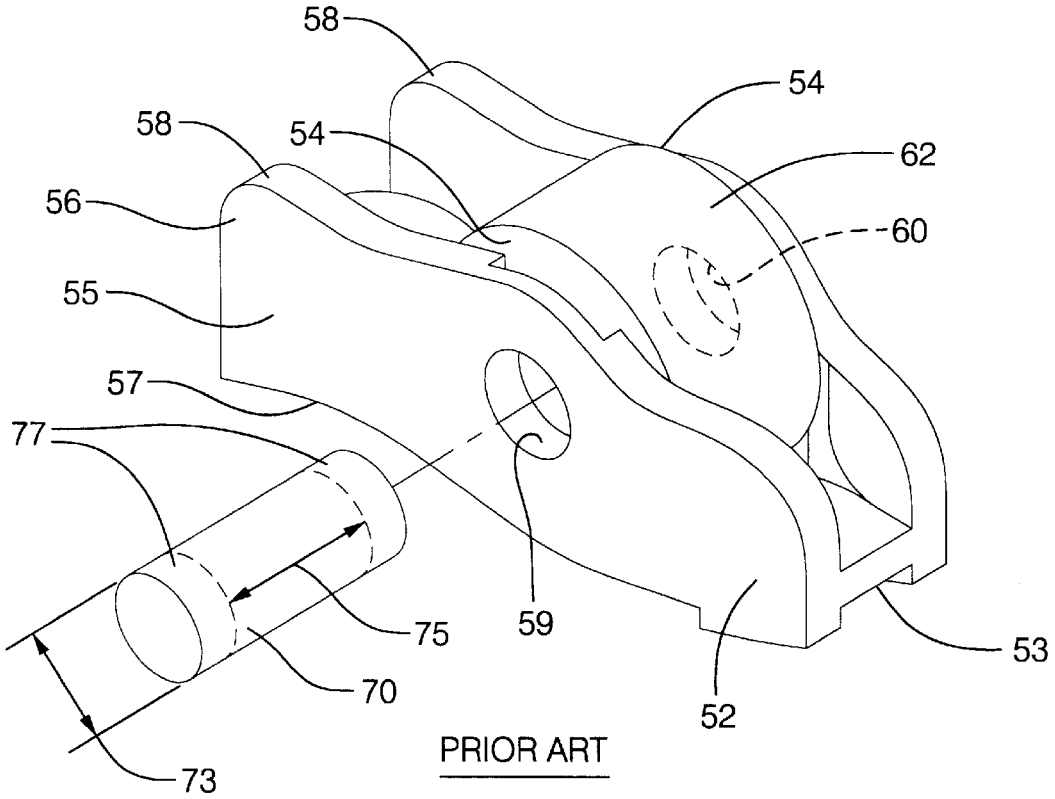
PRIOR ART FIG. 2
FIG. 2 is a partially exploded perspective view of a prior art RFF showing the roller shaft, roller bearing and follower finger.

Referring to FIG. 2, the known RFF is comprised of roller bearing 62, transverse shaft 70, and finger 55. The most commonly used roller bearing configuration, similar to that shown in FIG. 4*b*, incorporates a roller bearing 62 riding on needle bearings 64 which roll on transverse shaft 70. Another known combination, called a journal bearing as shown typically in FIG. 4*a*, uses a solid roller bearing 62 without needle bearings. Center bore 65 of journal bearing 62 (FIG. 4*a*) is machined to be in close tolerance with outer diameter 73 of shaft 70. In both the needle bearing type and the journal bearing type roller bearing assembly, the transverse shaft 70 has a hardened cylindrical surface 75. Thus, in operation, either the center bore 65 of journal bearing type roller bearing, or the set of needle bearings of the needle bearing type roller bearing is in direct contact with the hardened cylindrical surface 75 of shaft 70.

Referring again to FIG. 2 of the prior art, follower finger 55 includes first end 52 defining valve actuating pad 53, second end 56 defining pivot recess 57, and generally parallel side walls 58. Side walls 58 contain first bore 59 and second bore 60 positioned in axial alignment with each other and formed generally perpendicular to the longitudinal axis of the finger. The diameter of the first and second bores is selected to be slightly larger than diameter 73 of shaft 70 for receiving ends 77 of shaft 70. With roller bearing 62 in place on shaft 70, and ends 77 of shaft 70 in place in first and second bores 59 and 60 of side walls 58, ends 77 of shaft 70, which are softer that the hardened cylindrical surface 75 of the shaft, are mechanically deformed as by orbital staking or the like, as known in the art. Thus, once the staking operation is completed, roller bearing 62 rotates freely on shaft 70 while shaft 70 is fixed from axial rotation and lateral movement, relative to finger 55. Side walls 58 of finger 55, positioned adjacent to first and second diametral surfaces 54 of roller bearing 62 restrain roller bearing 62 from excessive lateral movement.

Referring again to FIG. 1*a*, in assembly, pivot recess 57 of second end 56 of follower finger 55 is pivotally engaged with plunger cap 36 at upper end 29 of HLA member 25. Lower end 32 of HLA member 25 is anchored in mating pocket 13 in cylinder head 12. Valve actuating pad 53 of first end 52 of finger 55 is in contact with the end of valve stem 20. In the view shown in FIG. 1*a*, valve 15 is in its closed position seated against valve seat 14. In the same view, circular portion 31 of the cam is engaged with roller bearing 62 of RFF 10.

In operation, roller bearing 62 follows the profile of rotating cam lobe 30 causing valve 20 to open when cam lobe 30 comes in contact with the roller bearing 62. FIG. 1*b* shows cam lobe 30 in contact with roller bearing 62. In this position, with plunger cap 36 of HLA member 25 acting as a fulcrum, cam lobe 30 coming in contact with roller bearing 62 causes first end 52 of follower finger 55 to move downward thereby moving valve stem 20 downward and opening the valve 15.

Figure 3:
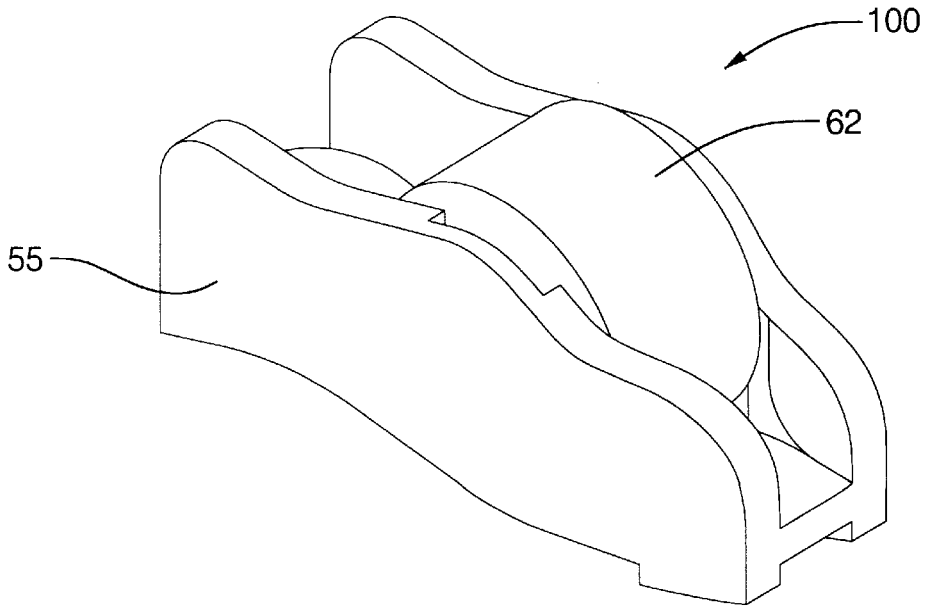
FIG. 3 is a perspective view of a RFF assembly in accordance with the present invention.
Figure 2A:
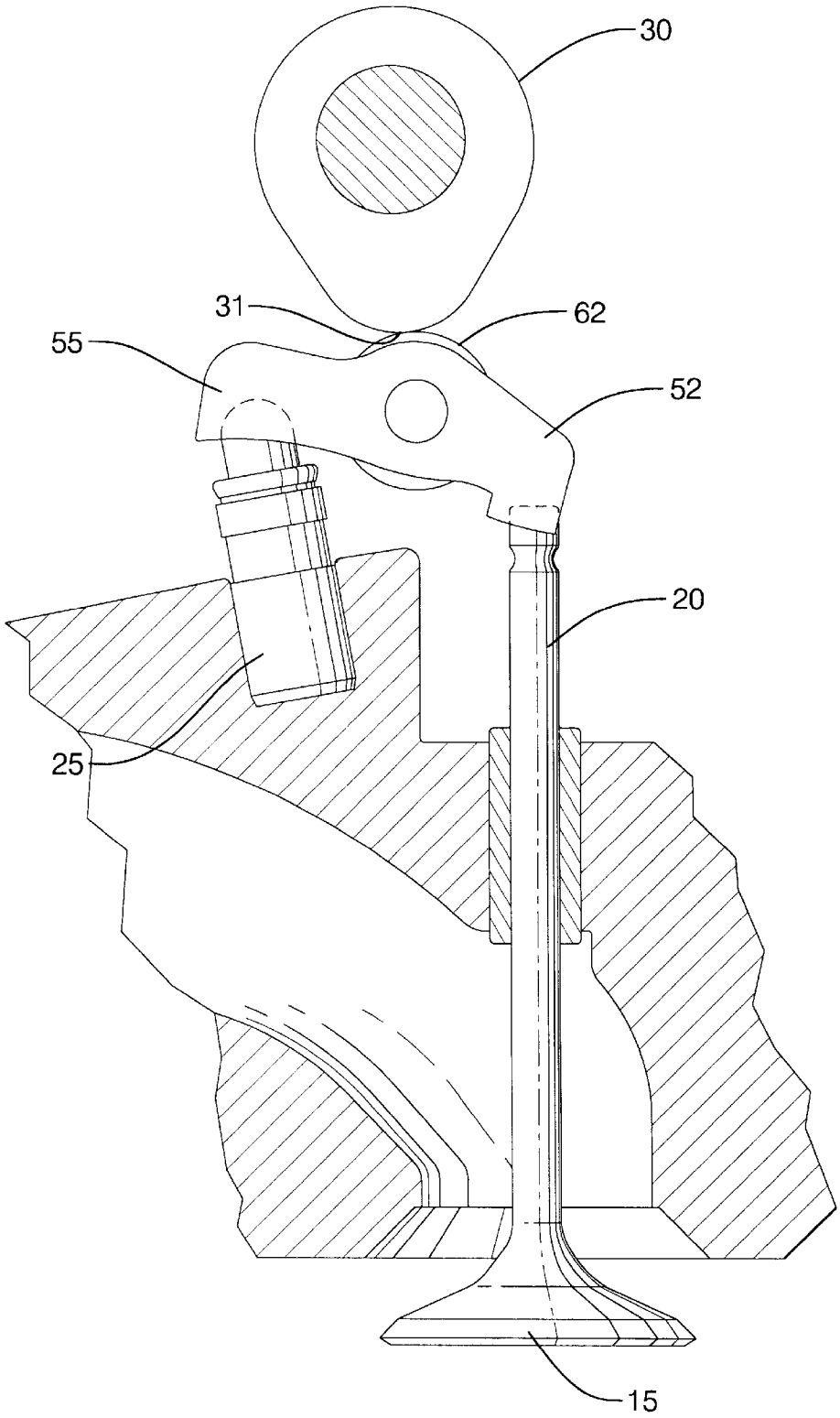
PRIOR ART FIG. 2 A
FIG. 2A is a schematic drawing of the RFF of FIG. 1*a*, but showing the cam lobe rotated to open the valve.
Figure 4A:
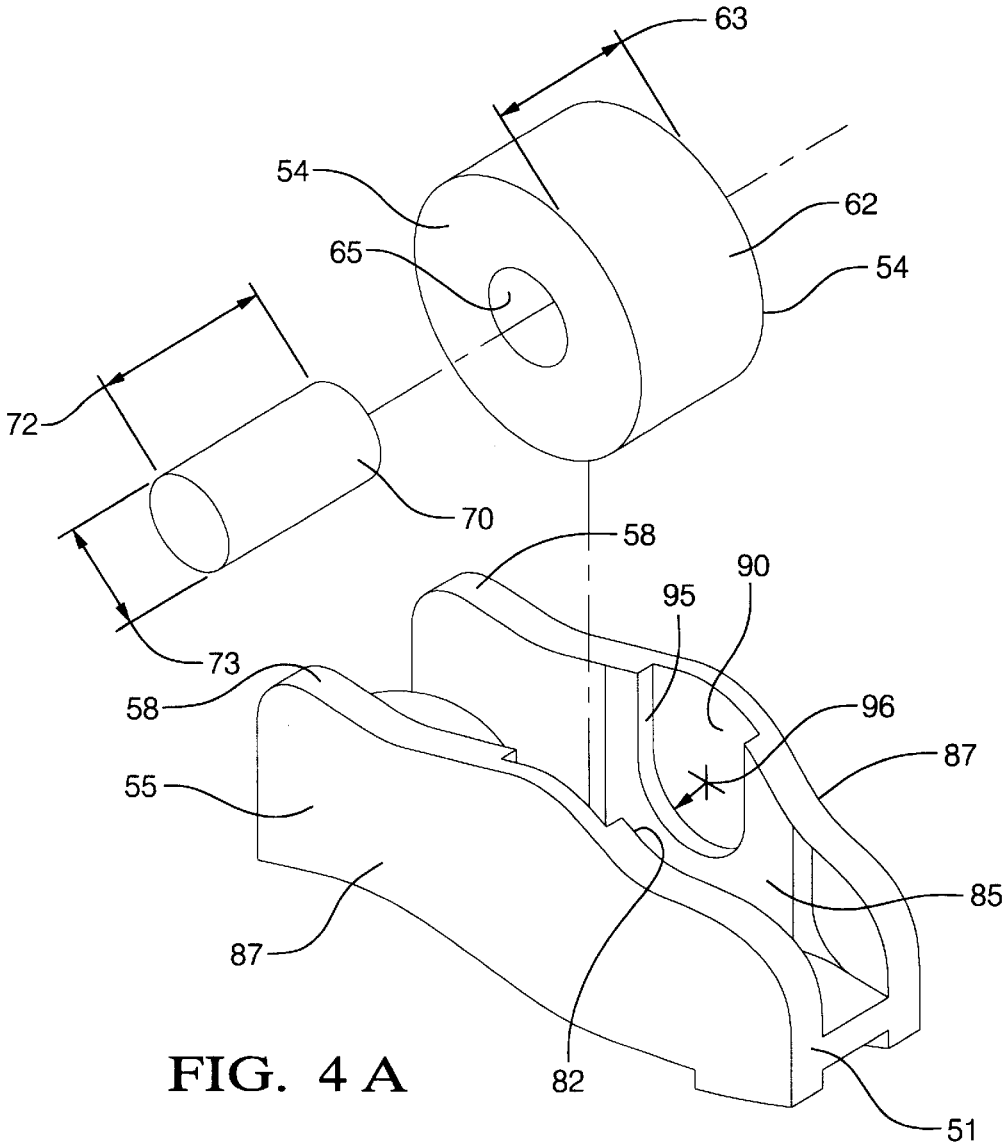
FIG. 4A is an exploded view of the RFF assembly shown in FIG. 3, with a journal type roller bearing.
Figure 4B:
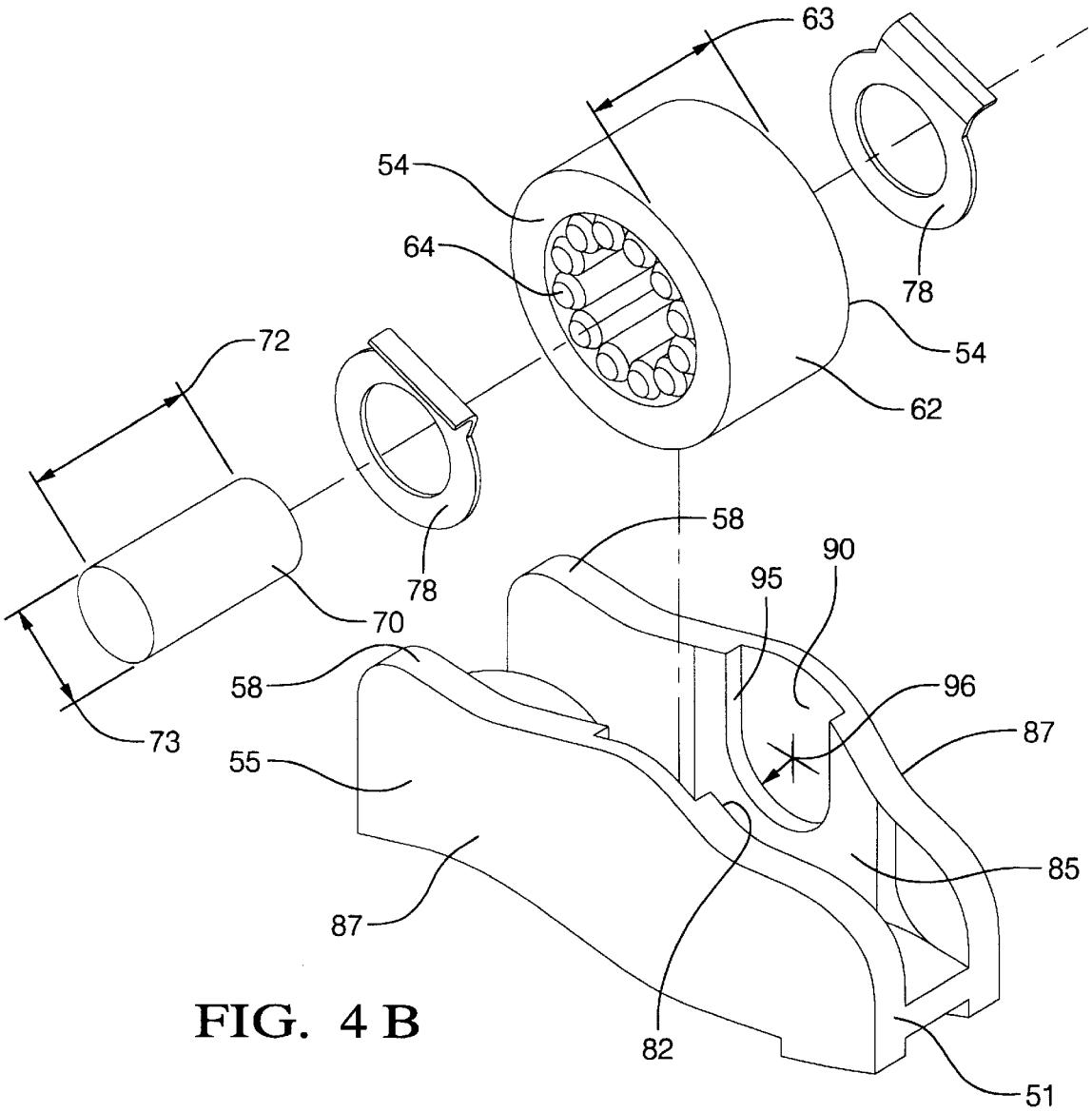
FIG. 4B is an exploded view of the RFF shown in FIG. 3, with a needle bearing type roller bearing with internal needle bearings and thrust washers.

FIG. 3 in contrast to FIG. 2 shows RFF 100 in accordance with a first embodiment of the invention. As more clearly shown in FIG. 4*a*, the invention includes roller bearing 62 and transverse shaft 70. As similarly described in the prior art, the roller bearing 62 and shaft 70 can be of the journal bearing type as shown in FIG. 4*a*, where diameter of center bore 65 of bearing 62 is machined to be in close tolerance with outer diameter 73 of shaft 70, typically within about 0.02 inches. Alternatively, the roller bearing and transverse shaft can be of the needle bearing type well known in the art as shown in FIG. 4*b* and described previously. When a needle bearing type is used, side thrust washers 78 are desirous to restrain lateral movement of the needle bearings 64 during operation and to keep needle bearings 64 from cutting into inner surfaces 82 of side walls 58. Other combinations known in the art are also possible.

In accordance with the invention, follower finger 55 includes bottom wall 51 and adjacent side walls 58 defining internal cavity 85 for receiving the roller bearing 62 and transverse shaft 70. Side walls 58 are constructed to be generally parallel to each other. Each side wall has inner surface 82 and outer surface 87. Inner surfaces 82 contain a means for positioning roller bearing 62 and transverse shaft 70 in proper relation to follower finger 55 without the need for machining through bores in the finger or for staking the ends of the shaft in place.

Figure 5:
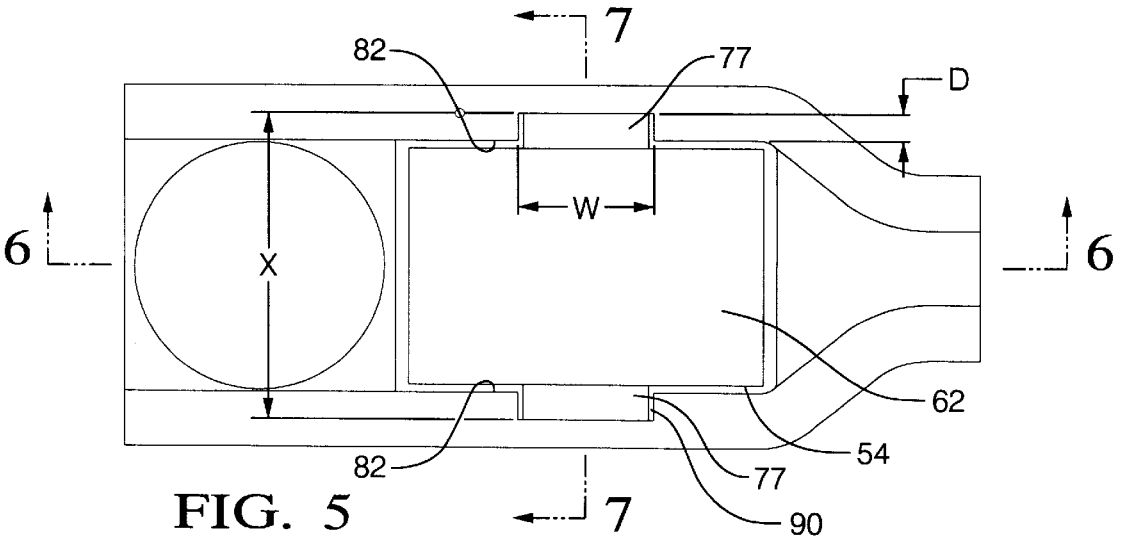
FIG. 5 is a top view of the RFF shown in FIG. 3.
Figure 6:
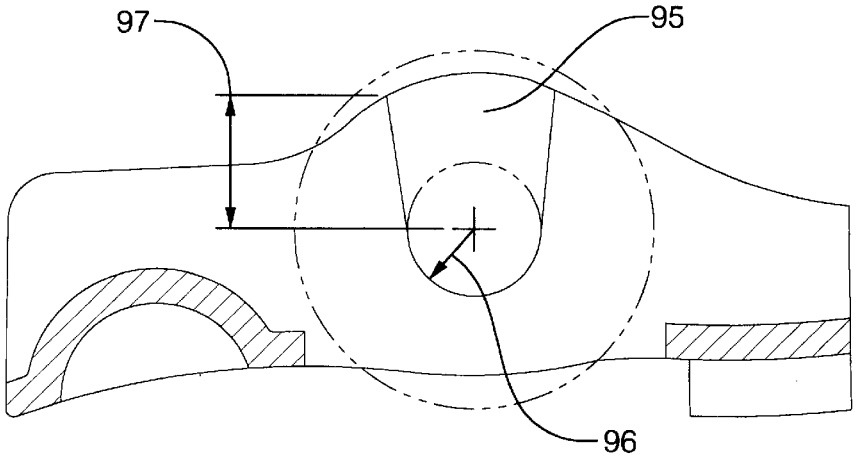
FIG. 6 is a cross-sectional view of the follower finger taken along line 6—6 in FIG. 5. The dotted lines show the roller bearing and shaft in position.

Referring to FIGS. 4*a*, 4*b* and 5, numeral 90 generally indicates the positioning means in accordance with the invention. Disposed in each side wall inner surface 82 is notch 95 sized and positioned to receive in close tolerance fit ends 77 of transverse shaft 70. Radius 96 at the bottom of each notch is equal to or slightly larger than one half the diameter 73 of transverse shaft 70. Notch width W is slightly larger than the diameter 73 of transverse shaft 70, preferably approximately 0.05 mm larger. Notch depth D is selected so that dimension X measured perpendicular to the longitudinal axis of finger 55 is slightly larger than the length 72 of transverse shaft 70, preferably approximately 0.01 mm larger. Length 72 of transverse shaft 70 is greater than width 63 of roller bearing 62 thereby providing means for ends 77 of transverse shaft 70 to nest in radius 96 at the bottom of each notch 95. To provide adequate support for the roller bearing under cam loading, it is preferable that notch depth D be at least 1.5 mm. It is noted that notch width W is slightly larger than diameter 73 of transverse shaft 70 only at a point at or near the base of each notch 95 in order to control the radial position of transverse shaft 70. Above that point, defined as numeral 97 (FIG. 6), notch width W can flare or taper outward to help guide ends 77 of shaft 70 into radius 96 at the bottom of each notch 95 as the shaft and roller are assembled into follower finger 55.

Once assembled, center bore 65 of journal roller bearing 62 rides on transverse shaft 70. Alternatively, as shown in FIG. 4*b*, roller bearing 62 rides on needle bearings 64 which roll on transverse shaft 70. Other forms of bearings could be used if desired. Ends 77 of transverse shaft 70 extend beyond opposite diametral surfaces 54 of roller bearing 62. Opposite ends 77 of transverse shaft 70 are received in side wall notches 95 to position roller bearing 62 in proper relation to the follower finger 55. Lateral movement of the roller bearing 62 is restrained by inside wall surfaces 82. Lateral, downward, and fore and aft movement of transverse shaft 70 is restrained by notch 95 disposed in each side wall 58. Upward movement of transverse shaft 70 is restrained by cam lobe 30 in rotating contact with roller bearing 62.

In accordance with the invention, since ends of shaft 77 need not be staked to hold shaft 70 in lateral position, the shaft itself may be fully hardened without the requirement for maintaining soft ends for staking as in the prior art. Alternately, transverse shaft 70 can be made entirely of a material known in the art for its wear resistant qualities, such as ceramic. Those of ordinary skill in the art will recognize that other wear resistant shaft materials will work with the principles of the present invention. Since transverse shaft 70 is free to rotate in notches 95 about its own axis, its entire surface is subjected to the downward force exerted by cam lobe thereby extending the wear life of the RFF assembly. Further, since the invention permits relative rotational motion between both the roller bearing and the shaft and the shaft and follower finger, shaft wear is more evenly distributed.

Figure 7:
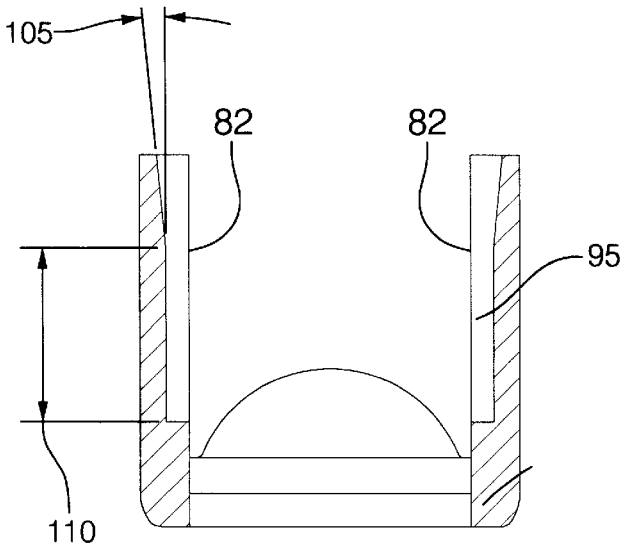
FIG. 7 is a cross-sectional view of the follower finger taken along line 7—7 in FIG. 5.
Figure 8:
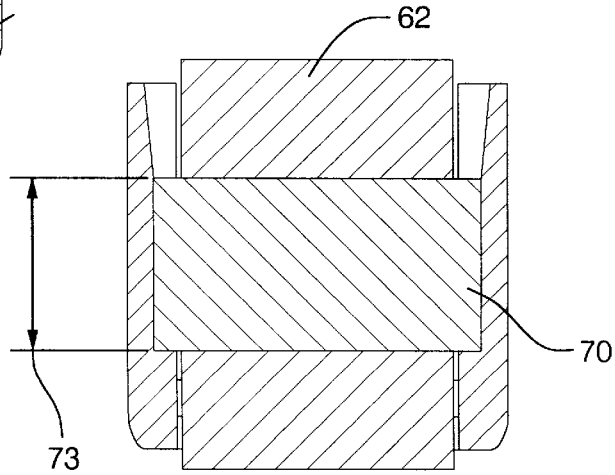
FIG. 8 is the cross-sectional view of FIG. 7 with a cross section of the roller bearing and shaft in place cut along their diameters.

Referring to FIGS. 7 and 8 there is shown an alternative embodiment of the invention. As in the previously discussed embodiment, the size and position of each side wall notch 95 and side wall inner surface 82 serve to properly position transverse shaft 70 and roller bearing 62 relative to the follower finger 55. To aid in the assembly of transverse shaft 70 in notches 95, taper 105 is provided at the entrance of each notch in the alternate embodiment. In order to assure adequate lateral support for the transverse shaft 70, the size and position of taper 105 should be selected so that the length of parallel side walls shown as numeral 110 in FIG. 7 is no less than one half the diameter 73 of transverse shaft 70.

Figure 9:
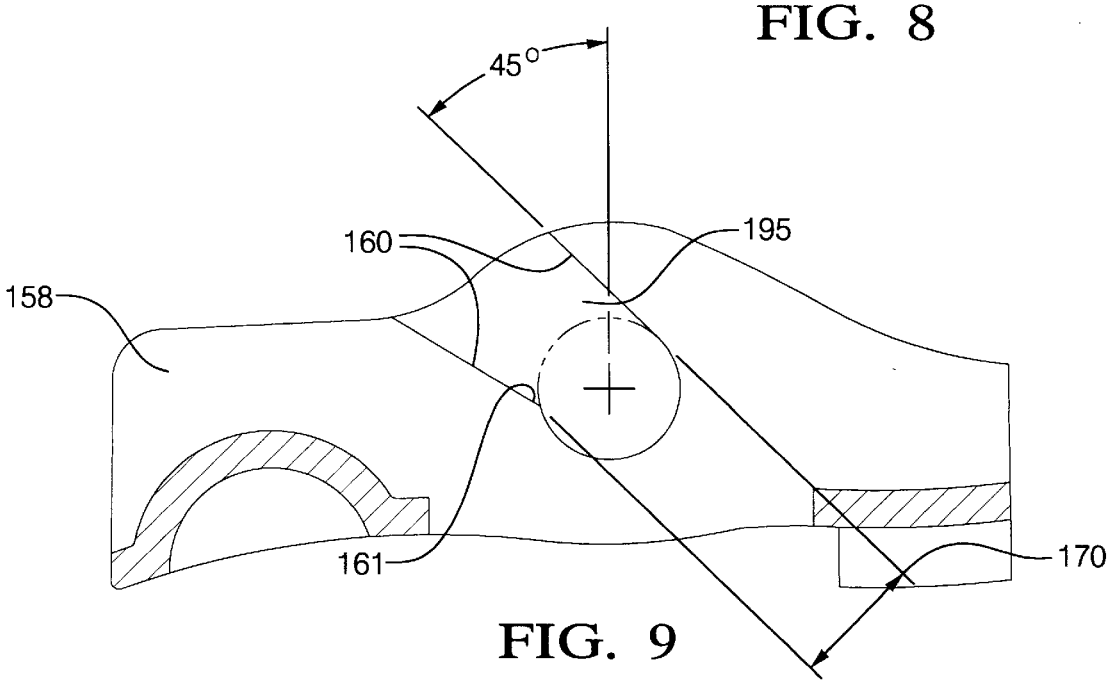
FIG. 9 is a cross-sectional view of another embodiment of the follower finger of the invention taken along line 6—6 in FIG. 5.

The embodiments described up to this point serve to fully restrain lateral and radial movement of the transverse shaft 70 and roller bearing 62 of the RFF without the need for machined bores in the side walls of the follower finger and without the need for staking ends 77 of shaft 70, once the RFF and mating parts, including overhead cam 30, are installed on the engine. However, since installation of overhead cam 30 is needed to restrain shaft 70 and roller bearing 62 from movement in the upward direction relative to follower finger 55, it is recognized that it may be desirous to provide means to fully restrain shaft 70 and roller bearing 62 when the RFF assembly is not installed in the engine. For example, during handling and shipping of the RFF. FIG. 9 depicts yet another notch embodiment to accomplish this. Notch 195 is formed in each finger side wall 158 according to notch depth (D) as described above. Sides 160 of notch 195 however are shaped so that side portion 161 reduces width 170 to a dimension less than diameter 73 of transverse shaft 70, preferably approximately 0.03 mm less. Thus, as transverse shaft 70 is received by notch 195 in finger side walls 158, shaft diameter 73 must pass notch side portion 161 of reduced width causing a slight interference condition. Once fully seated in bottom 196 of notch 195, transverse shaft 70 clears notch side portion 161 and is free to rotate about its axis. However, notch side portion 161 serves to restrain shaft 70 from upward movement before the RFF assembly is installed on the engine. FIG. 9 shows a notch according to this invention angled approximately 45 degrees from the vertical. It is understood that various angles can be selected from a range of angles ±45 degrees from the vertical according to the invention.

Figure 10A:
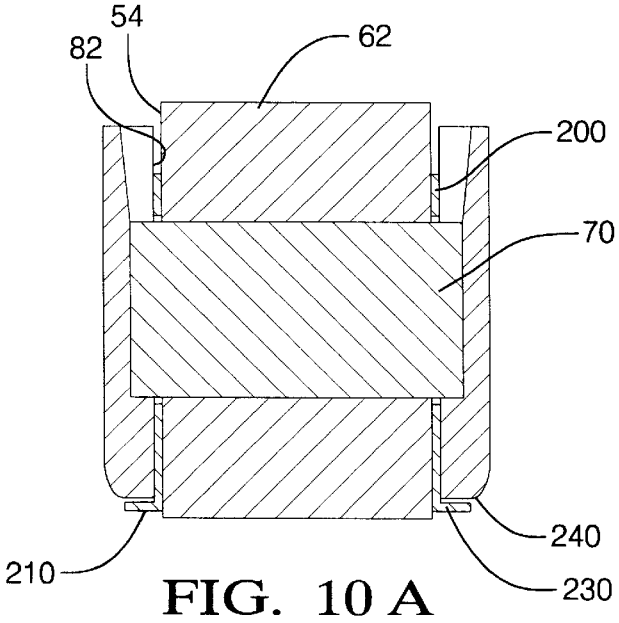
FIGS. 10A, 10B, and 10C are cross-sectional views of the invention similar to FIG. 8 showing the addition of retainer clips in accordance with the invention.
Figure 10B:
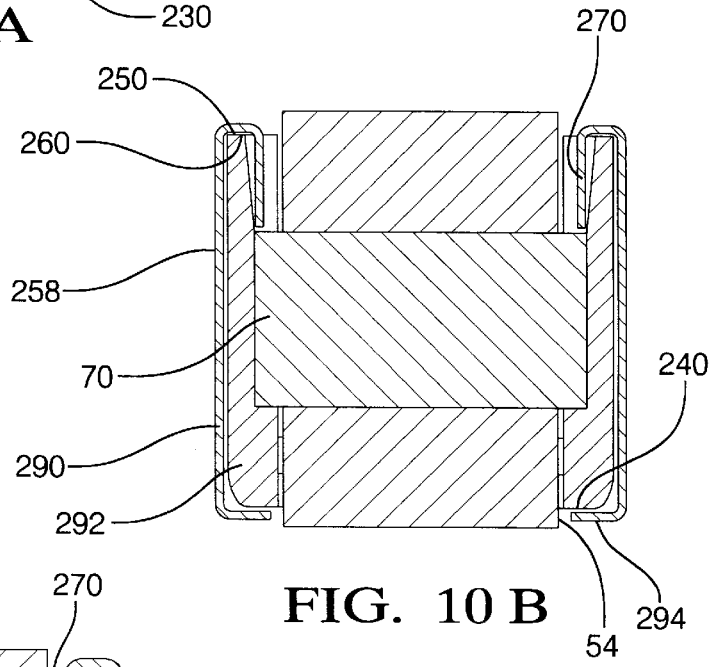
Figure 10C:
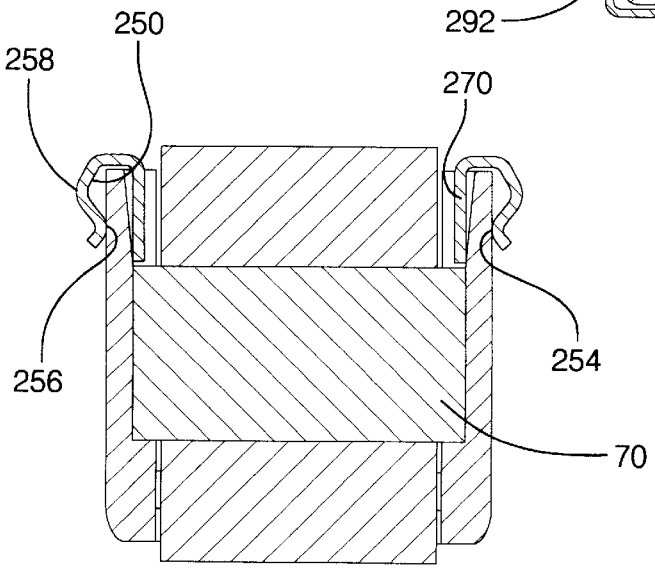
Figure 11A:
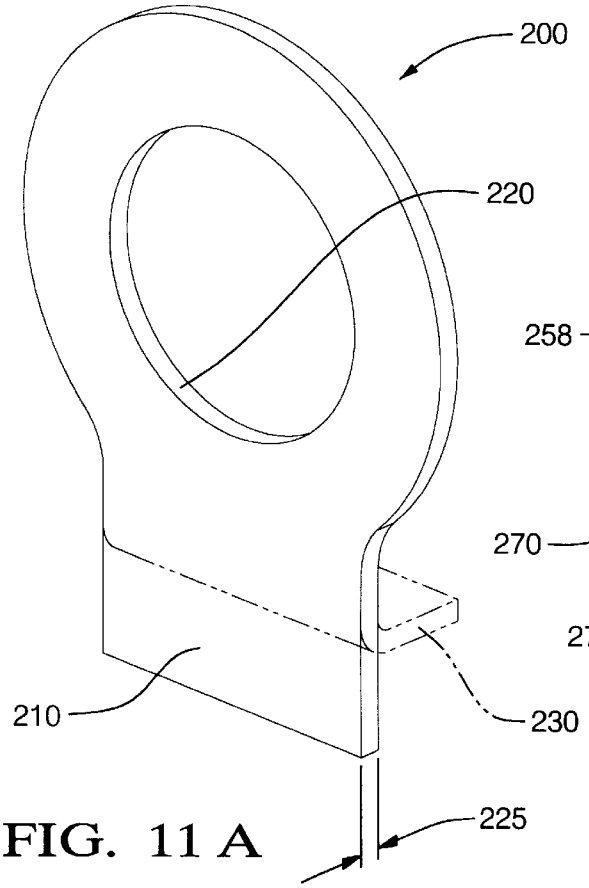
FIGS. 11A, 11B, and 11C are perspective views of the clips depicted in FIGS. 10*a*, 10*b* and 10*c*, respectively.
Figure 11B:
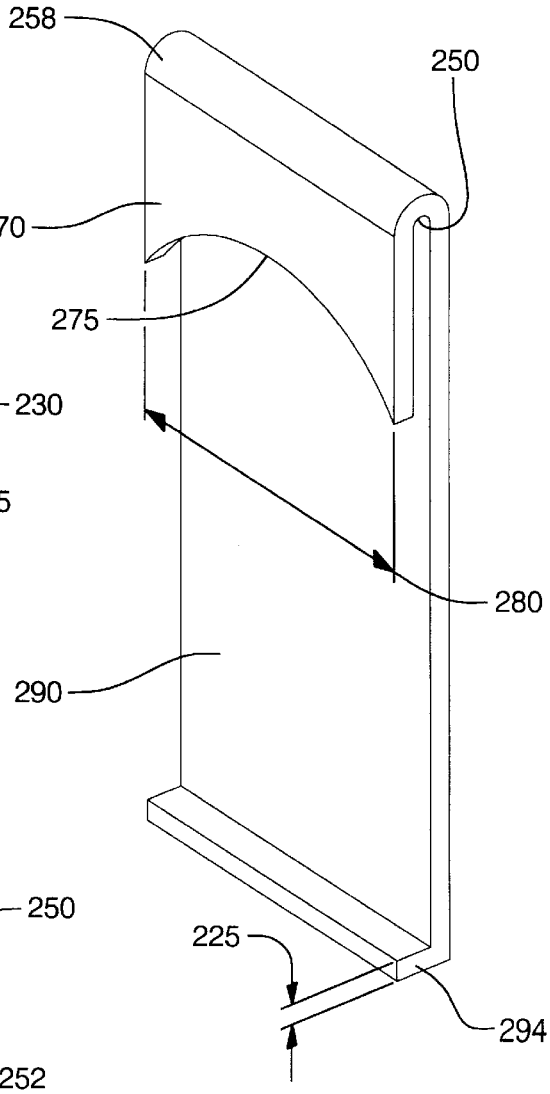
Figure 11C:
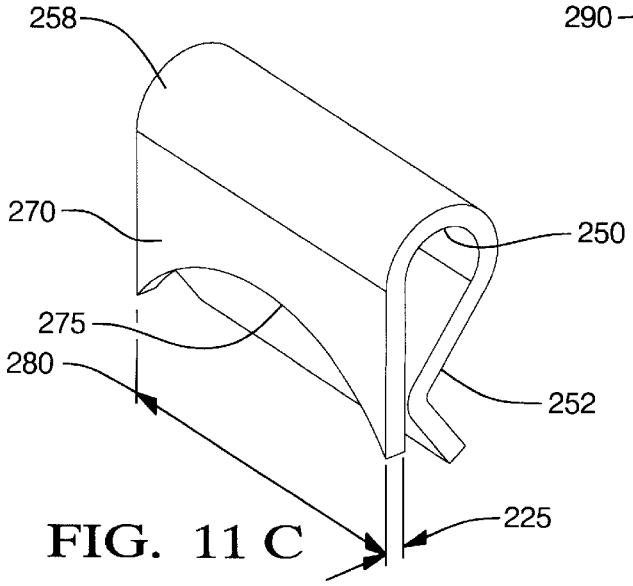

FIGS. 10 and 11 illustrate yet additional embodiments showing means for fully restraining transverse shaft when the RFF is not installed in the engine. FIGS. 10*a*, 10*b*, and 10*c* depict RFF assemblies using clips to restrain shaft 70. FIGS. 11*a*, 11*b*, and 11*c* illustrate the clips used in the depicted RFF assemblies. Referring to FIG. 10*a* and 11*a*, this embodiment uses washer clip 200 on each end of transverse shaft 70. Washer clip 200 is fabricated of bendable steel and includes tab 210. Internal diameter 220 is larger than outer diameter 73 of shaft 70 so as to freely fit over shaft end 77. Washer clip thickness 225 is selected to fit between each diametral surface 54 of roller bearing and its associated side wall inner surface 82 so as not to bind the roller bearing 62 from free rotational movement. In assembly, first the roller bearing 62 is installed onto transverse shaft 70. Then, washer clip 200 is placed over each shaft end 77. With tab 210 of each washer clip 200 oriented downward, roller bearing assembly comprising shaft 70, roller bearing 62 and washer clips 200 are then receivably inserted into the follower finger as described in the previous embodiments. Once inserted, tab 210 of each washer clip is bent outwardly 230 over lower surface 240 of finger 55 thereby locking shaft and roller bearing from upward movement. Each washer clip 200 can also be fabricated from spring steel or other resilient material so that tab 210 is preformed in the shape shown as numeral 230. In the after embodiment, the tab would be resiliently deformed as the shaft, roller bearing, and washer clips are receivably inserted into follower finger 55. Once fully inserted, the preformed tabs of the washer clips would fit tightly over lower surface 240 of finger 55. These embodiments for restraining shaft 70 and roller bearing 62 can be used with either journal bearing type or needle bearing type roller bearings. When used with a needle bearing type roller bearing, washer clip 200 also serves as side thrust washer 78 as shown in FIG. 4*b* to restrain the needle bearings from axial movement.

FIGS. 10*b* and 10*c*, and 11*b* and 11*c* illustrate yet further embodiments of clip 258 used as means for fully restraining transverse shaft 70 when the RFF is not installed in the engine. In both embodiments, clip upper shoulder 250 is contoured to fit around top edge 260 of follower finger side wall. Arms 270 of clip terminate in an arcuate shape 275 to fit loosely around outside diameter 73 of transverse shaft 70 so as not to interfere with the axial rotation of shaft 70. Width 280 across arms 270 is less than notch width W to permit width of arms to fit inside notch 95. Thickness 225 of clip 258 is selected to be less than notch depth D so as not to interfere with the rotational movement of roller bearing 62. In the embodiment shown in FIGS. 10*b* and 11*b*, clip leg 290 extends downward to follow the contour of outside surface 292 of side wall, then turns inward, shown as numeral 294, to securely lock the clip in place around lower surface 240 of follower finger. Clip end 294 terminates at a point short of making contact with roller bearing diametral surface 54. In the embodiment shown in FIGS. 10*c* and 11*c*, clip upper shoulder 250 is formed in an "S" shape 252 and terminates at a point laterally along upper outer side wall 254. At the point in which the clip makes contact with upper outer side wall 254, slot 256, which can be either an appendage or recess, is formed in the upper outer side wall thereby securely positioning the clip shoulder 250 to the upper outer side wall 254. Clip 258 depicted in FIGS. 11*b* and 11*c* is fabricated from spring steel or similar resilient material. The embodiments for restraining shaft 70 and roller bearing 62 as illustrated in FIGS. 10*b* and 10*c* and 11*b* and 11*c* can be used with either journal bearing type or needle bearing type roller bearings. However, when used with a needle bearing type roller bearing, it is preferable that side thrust washer 78 as shown in FIG. 4*b* be used in conjunction with clip 258. With the addition of side thrust washer 78, additional clearance for the thrust washer between diametral surface 54 of roller bearing 62 and side wall inner surface 82 must be provided.

The foregoing description of the several embodiments of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A roller finger follower for use in an internal combustion engine having an overhead cam comprising:

a follower finger having a pair of opposed side walls and two notches, one in each of the side walls;

a transverse shaft;

a roller bearing mounted on the shaft wherein the shaft is received by the notches such that the notches limit axial movement of the shaft and the overhead cam is in contact with the bearing to keep the bearing in place in the follower finger.

2. The roller finger follower of claim 1 wherein said roller bearing has a center bore, said shaft has a cylindrical surface, and said roller bearing shaft is mounted for rotational movement within said bore.

3. The roller finger follower of claim 2 wherein said shaft is steel.

4. The roller finger follower of claim 3 wherein said cylindrical surface is hardened.

5. The roller finger follower of claim 2 wherein said shaft is ceramic.

6. The roller finger follower of claim 1 wherein said roller bearing has a center bore to receive a plurality of needle bearings, said shaft has a cylindrical surface, and said shaft is mounted for rotational movement on said plurality of needle bearings.

7. The roller finger follower of claim 6 wherein said shaft is steel.

8. The roller finger follower of claim 7 wherein said cylindrical surface is hardened.

9. The roller finger follower of claim 6 wherein said shaft is ceramic.

10. A roller finger follower for use in an internal combustion engine comprising:

a follower finger having a pair of opposing side walls and two notches, one in each of the side walls;

a transverse shaft having ends;

a roller bearing mounted on the shaft wherein the shaft is received by the notches such that the notches limit axial movement of the shaft; and means for retaining the shaft ends in each said notch from upward movement.

11. The roller finger follower of claim 10 wherein said means for retaining shaft ends include a notch side portion.

12. The roller finger follower of claim 10 wherein said means for retaining shaft ends include at least one clip in tight fitting relationship to said follower finger.

13. The roller finger follower of claim 12 wherein said clip is a washer clip.

14. The roller finger follower of claim 13 wherein the washer clip has a tab, said tab being deformable to fit over said follower finger.

* * * * *